US009272753B2

(12) United States Patent
Heyring et al.

(10) Patent No.: US 9,272,753 B2
(45) Date of Patent: Mar. 1, 2016

(54) IMPROVEMENTS TO MULTI-HULL VESSEL SUSPENSION GEOMETRY

(71) Applicant: Nauti-Craft Pty Ltd, Dunsborough (AU)

(72) Inventors: Christopher Brian Heyring, Eagle Bay (AU); John Gerard Catoni, Dunsborough (AU); Mark David Sampson, Dunsborough (AU)

(73) Assignee: Nauti-Craft Pty Ltd, Dunsborough WA (AU)

( * ) Notice: Subject to any disclaimer, the term of this patent is extended or adjusted under 35 U.S.C. 154(b) by 0 days.

(21) Appl. No.: 14/405,921

(22) PCT Filed: Jun. 5, 2013

(86) PCT No.: PCT/AU2013/000593

§ 371 (c)(1),
(2) Date: Dec. 5, 2014

(87) PCT Pub. No.: WO2013/181699

PCT Pub. Date: Dec. 12, 2013

(65) Prior Publication Data

US 2015/0298766 A1 Oct. 22, 2015

(30) Foreign Application Priority Data

Jun. 5, 2012 (AU) ..... 2012902326

(51) Int. Cl.

| | |
|---|---|
| ***B63B 1/12*** | (2006.01) |
| ***B63B 1/14*** | (2006.01) |
| ***B63B 17/00*** | (2006.01) |
| ***B63B 39/00*** | (2006.01) |

(52) U.S. Cl.

CPC . *B63B 1/121* (2013.01); *B63B 1/14* (2013.01); *B63B 17/00* (2013.01); *B63B 39/00* (2013.01); *B63B 2001/123* (2013.01); *B63B 2017/0072* (2013.01)

(58) Field of Classification Search

CPC ..... B63B 1/00; B63B 1/14; B63B 1/16; B63B 1/22; B63B 1/12; B63B 1/121; B63B 39/00; B63B 17/00

USPC ..... 114/61.16, 283

See application file for complete search history.

(56) References Cited

U.S. PATENT DOCUMENTS

| | | | |
|---|---|---|---|
| 2,077,526 | A | 4/1937 | Messier |
| 2,584,122 | A | 2/1952 | Gilmore |
| 3,517,632 | A | 6/1970 | Gray |
| 5,228,404 | A | 7/1993 | Gibbs |

OTHER PUBLICATIONS

PCT/AU2013/000593 International Preliminary Report on Patentability dated Apr. 29, 2014 (5 pages).

PCT/AU2013/000593 International Search Report dated Sep. 2, 2013 (6 pages).

*Primary Examiner* — Lars A Olson

(74) *Attorney, Agent, or Firm* — Michael Best & Friedrich LLP

(57) ABSTRACT

A hull locating arrangement for a multi-hulled vessel having a body at least partially suspended above at least a first and a second hull by support components is disclosed. The hull locating arrangement comprises, for a hull, a first locating linkage and a second locating linkage to together constrain the hull in the lateral, longitudinal, roll and yaw directions relative to the body. The first and second locating linkages are longitudinally spaced, and the first locating linkage includes a first part and a second part, one of the parts of the first locating linkage being pivotally connected to the body about a body end pivot axis, and the other of the parts being pivotally connected to the hull about a hull end pivot axis. The first locating linkage is also arranged to permit relative motion between the first and second parts along at least one sliding axis to thereby permit the first locating linkage to vary in length between the body end pivot axis and the hull end pivot axis. The support components include a first support component adjacent the first locating linkage, the first support component including a first support element providing a support force supporting a portion of the body above the first hull. The support force of the first support element has a line of action that is within thirty degrees of parallel to a first linkage plane extending through the body end pivot axis and the hull end pivot axis.

21 Claims, 11 Drawing Sheets

IMPROVEMENTS TO MULTI-HULL VESSEL SUSPENSION GEOMETRY

FIELD OF THE INVENTION

The present invention is generally directed to water craft and in particular to methods of or systems/arrangements for at least partially suspending or supporting a body above at least two movable hulls.

BACKGROUND OF THE INVENTION

In the applicant's earlier International Patent Application Numbers PCT/AU2011/000557 and PCT/AU2011/000565 there are disclosed various configurations of catamaran, trimaran and quadmaran all having resilient suspension between at least two laterally spaced hulls and central hull or body. Where two longitudinally spaced locating linkages are provided between one hull and the body some form of longitudinal compliance or freedom is required in one of the locating linkages. For example to locate one hull relative to the body, a front fixed length trailing arm is used and a back variable length trailing arm is used. The variable length of the back trailing arm is provided by telescopic or sliding sections in the arm or by a drop link. The support forces are provided by rams which provide a moment on the trailing arms which can require the trailing arms to be of very high strength and large section on some vessels and places a high side load on the sliding joints of the variable length arm which increases the friction of the sliding joints and therefore reduces joint life and ride comfort. Alternatively the rams are provided connected directly between the body and the hull, which can require a large tower on the deck of the body to accommodate the rams which can be difficult to package in some vessel designs and layouts. Also wherever the suspension arms and rams are located in separate areas of the vessel, having separate load paths through respective mounting points into the body and/or the hull(s), the greater the spacing between the respective mounting points, generally the more bending induced into the body and/or hull and the less efficient the design in terms of packaging and weight.

SUMMARY OF THE INVENTION

According to a first aspect of the invention there is provided a hull locating arrangement for a multi-hulled vessel having a body at least partially suspended above at least a first and a second hull by support components, the hull locating arrangement comprising for a said hull a first locating linkage and a second locating linkage to together constrain said hull in the lateral, longitudinal, roll and yaw directions relative to the body, the first and second locating linkages being longitudinally spaced from each other. The first locating linkage includes a first part and a second part, one of said parts of the first locating linkage being pivotally connected to the body about a body end pivot axis, the other of said parts being pivotally connected to said hull about a hull end pivot axis. The first locating linkage being arranged to permit relative motion between the first and second parts along at least one sliding axis to thereby permit the first locating linkage to vary in length between the body end pivot axis and the hull end pivot axis. The support components including a first support component adjacent the first locating linkage, the first support component including a first support element providing a support force supporting a portion of the body above the said hull, wherein the support force of the first support element of the first support component has a line of action that is within thirty degrees of parallel to a first linkage plane extending through the body end pivot axis and the hull end pivot axis.

The support force of the first support element may have a line of action that is aligned with or at a tighter angle of for example 5, 10 or 20 degrees of parallel to the first linkage plane.

The line of action of the support force of the first support element may be offset from the body end pivot axis or the hull end pivot axis or the first linkage plane by a distance of less than ten percent of a length of the first hull, for example 2, 5 or 10 percent of the (waterline) length.

The at least one sliding axis of the first locating linkage may include at least two laterally spaced sliding axes defining a first sliding plane and the line of action of the support force of the first support element may be substantially aligned with said first sliding plane. The line of action of the support force of the first support element may be substantially aligned with both the first linkage plane (and the first sliding plane) to thereby minimise bending moments and side loads in the first locating linkage resulting from the support force.

The first locating linkage may include bearings or bushings to permit the relative motion between the first and second parts along said at least one sliding axis.

The hull end pivot axis and the body end pivot axis of the first locating linkage of said hulls may be aligned substantially laterally with respect to the body of the vessel.

The first support component may further include a second support element. The first and/or second support element may be connected between the first part and the second part.

The at least one sliding axis may be a single sliding axis.

Alternatively, the at least one sliding axis may be a pair of parallel first and second laterally spaced sliding axes. Bearings or bushings may be provided between the first part and the second part and may be arranged to effectively constrain the relative motion between the first and second parts to a linear sliding motion along said first and second laterally spaced sliding axes, said sliding axes being parallel to each other and substantially perpendicular to the body and hull end pivot axes.

The first linkage plane of the first locating linkage may be substantially perpendicular to the body of the vessel during operation. However due to practical limits on the lengths of arms and other geometry considerations, the first linkage plane of the first locating linkage may only be substantially perpendicular to the main body during a part of the total range of operation of the first locating linkage. So alternatively the first linkage plane of the first locating linkage may be within 5, 10, 20, 30 or even 40 degrees of perpendicular to the body of the vessel during operation.

The second locating linkage may constrain the longitudinal motion of the hull relative to the body.

The support components may further include second support components for providing support forces in the second locating linkage between said hull and the body.

The support force of the first support means acts (or has a line of action that is) substantially parallel to the at least one sliding axis of the first locating linkage. Alternatively, the support force of the first support means may act in a direction (or have a line of action) that is substantially aligned with either the at least one sliding axis of the first locating linkage or a plane defined at least in part by the at least one sliding axis of the first locating linkage.

Where the first locating linkage is variable in length along a first sliding axis, the variable length of the first locating linkage may vary within a range defined as a first locating linkage stroke distance. The first support component may be arranged such that the resultant force has a line of action substantially aligned with the first sliding axis or passing within a distance from the first and second pivot axes of the first locating linkage that is less than twenty-five percent of said stroke distance.

The first support component may be connected between the first part and the second part.

One or more forms of the present invention may provide a multi-hulled vessel including a main body and at least one left hull and at least one right hull, each of said at least one left hull and at least one right hull being moveable with respect to the main body. At least one hull of said at least one left hull and at least one right hull is located relative to the main body by a hull locating arrangement according to the first aspect of the invention.

In an embodiment, the hull locating arrangement is arranged to constrain the hull relative to the main body in the lateral, longitudinal, roll and yaw directions, but to permit motion of the hull in the heave and pitch directions. To this end the hull locating arrangement includes longitudinally spaced first and second locating linkages. The first locating linkage is a variable length arm between the main body and the hull, the second locating linkage is a fixed length arm between the main body and the hull. A first end of the respective first and second locating linkages is rotatably connected to the main body by a respective first joint having a first pivot axis, a second end of the respective first and second locating linkages is rotatably connected to the hull by a respective second joint having a second pivot axis.

The first locating linkage may vary in length along a first sliding axis and the variable length of the first locating linkage may vary within a range defined as a first locating linkage stroke distance.

Additionally, the first locating linkage may further include support means providing a support force to support a portion of the main body above the hull.

The first locating linkage may further include support means providing a support force to support a portion of the main body above the hull, the support force having a line of action substantially aligned with the first sliding axis or passing within a distance from the first and second pivot axes of the first locating linkage that is less than twenty-five percent of said stroke distance (and is preferably substantially parallel to the first sliding axis).

The first locating linkage may include a first part connected to the first joint and a second part connected to the second joint, the first and second parts sliding relative to each other along the first sliding axis. The support means may be connected between the first part and the second part.

Additionally or alternatively, the support means may include multiple devices. The resultant force of said multiple devices may have a line of action substantially aligned with the first sliding axis or passing within a distance from the first and second pivot axes of the first locating linkage that is less than twenty-five percent of said stroke distance.

The first sliding axis may be within 40 degrees of vertical relative to the main body during operation. From a force standpoint, ideally the first sliding axis is substantial vertical with respect to the main body to minimise the longitudinal component of the support force input from the first locating linkage into the main body. However the geometry of the second locating linkage can require the first sliding axis to deviate from vertical. Also from a packaging standpoint it can be preferable to angle the first sliding axis from vertical to reduce the requirement for the first locating linkage to penetrate the hull or a deck area of the vessel.

It will be convenient to further describe the invention by reference to the accompanying drawings which illustrate preferred aspects of the invention. Other embodiments of the invention are possible and consequently particularity of the accompanying drawings is not to be understood as superceding the generality of the preceding description of the invention.

DESCRIPTION OF PREFERRED EMBODIMENT

Figure 1:
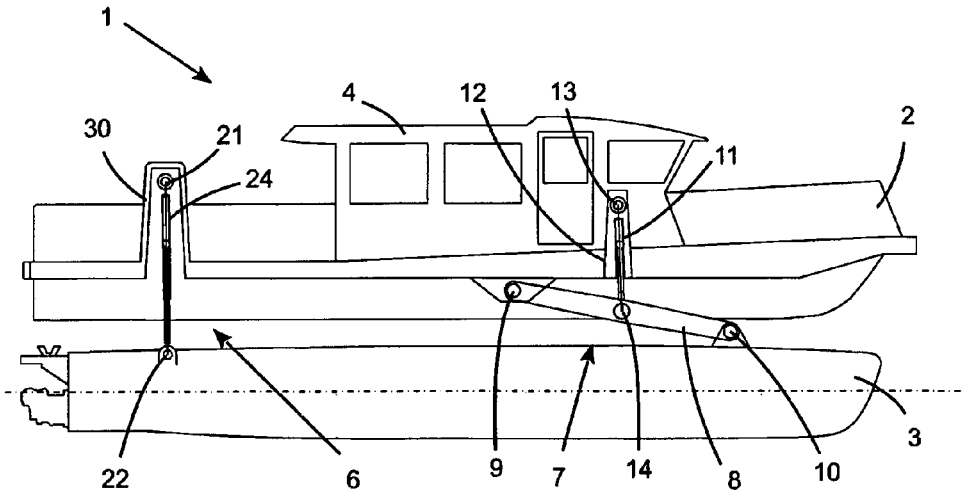
FIG. 1 is a side view of a vessel incorporating a hull locating arrangement according to the present invention.

Referring initially to FIG. 1 there is shown a catamaran 1 with a main body 2 suspended above the independently moveable hulls 3. The gunnels on the near side are omitted to fully expose the cabin 4 and the hull locating arrangement for the visible hull. The hull locating arrangement comprises a back hull locating linkage 6 and a front hull locating linkage 7.

The front locating linkage shown includes a leading arm 8 rotatably connected to the body 2 by pivot 9 such as bearings or bushings and rotatably connected to the hull 3 by pivot 10. This provides lateral, longitudinal and roll constraints to the motion of the hull relative to the body. Although it can also provide a yaw constraint, the use of a second lateral constraint at a longitudinally spaced position (i.e. the back locating linkage) generally provides most of the yaw reaction. A front support means 11 (such as a spring damper unit or one or more hydraulic cylinders) is provided, packaged inside a suspension tower 12 which can be located in the gunnels or in the cabin structure for example. The front support means is connected to the body by pivot 13 and to the leading arm by pivot 14. The distance of the connection point 14 of the front support cylinder 11 along the leading arm determines a mechanical advantage on the support cylinder and can be used for many beneficial reasons such as to reduce the total length of the cylinder (or other support means) to reduce the height of the suspension tower 12 and to improve the ratio of buckling strength versus weight of the cylinder 11.

Figure 2:
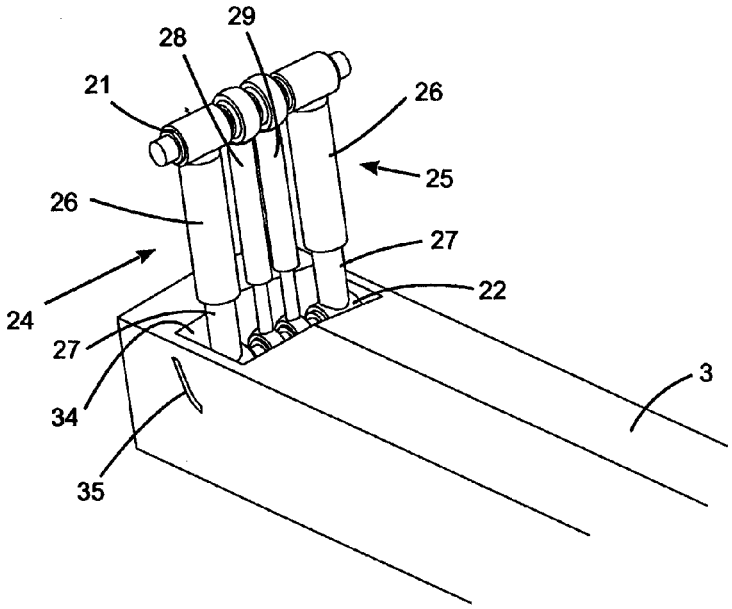
FIG. 2 is a perspective view of a first possible arrangement of the first locating linkage of the hull locating arrangement.

FIG. 2 shows the back hull locating linkage 6 in more detail with the body omitted for clarity. Although in the Figures the back hull locating linkage is shown substantially vertical with respect to the body at ride height, the linkage can be inclined to suit the packaging of the vessel, however this increases any longitudinal component of the rear support force acting on both the body and the hull and resolved through the leading arm. This rear locating linkage 6 is variable in length between the body pivot 21 and the hull pivot 22 and as shown in FIG. 2 includes a sliding frame made up of two laterally spaced sliding members 24 and 25. The sliding members are shown as cylindrical devices, but as the upper and lower pivots 21 and 22 reduce or remove the bending moment about laterally extending axes (such as the pivot axes of the pivots) the sliding members can be wider in section in a lateral direction than in a longitudinal direction. Each sliding member has two parts, one of which slides inside the other telescopically. The outer part 26 is shown connected to the body and the inner part connected to the hull although the frame can be used inverted so that the inner part 27 is connected to the body. Preferably bushings or bearings are used in pairs between the inner and outer parts of the sliding frame. For ease of maintenance these can be split shell bushes in the outer parts, although using a bush or bearing in the opposite end of each part from the pivots improves bearing spacing which can be beneficial.

As with the front hull locating linkage, one or more support means is used to provide support to the vessel body. In FIG. 2 the back support means is two hydraulic cylinders 28 and 29 which are connected either directly between the body and the hull or indirectly by being connected between the inner and outer parts of the sliding frame. The support means may comprise a supporting spring and a damper such as a hydraulic or pneumatic support cylinder and a shock absorber, or part of an interconnected suspension system such as those shown in the applicant's previously mentioned International patent applications, details of which are incorporated herein by reference.

The stroke of the suspension system (the vertical travel of the hull relative to the body) together with the lack of mechanical advantage (or lever ratio) of the back hull locating linkage 6 and back support cylinders 28 and 29 can require the top of the linkage to be housed above the deck of the body, such as in a suspension tower 30 which is preferably tied or integrated into the gunnels or the cabin or other superstructure as shown in FIG. 1. Alternatively or additionally the lower ends of the sliding frame and support means can be recessed into wells 34 or cut-outs in the hulls as shown in FIG. 2. Such a well can be sealed from the buoyant volume of the hull and to prevent water from collecting in the well 34 a vent 35 or other means of drainage can be provided as shown. Alternatively, the support means such as cylinders 28 and 29 can be located in one or more of the sliding members 24 and 25, in which case it is possible to use a single sliding member which penetrates the hull and is sealed by a flexible membrane between the sliding member and the hull.

A large stroke of the variable length arm arrangement with no mechanical advantage as shown in the rear linkage can require the support cylinders to be larger than hydraulically necessary to avoid the mechanical risk of buckling. This is particularly necessary when the cylinders are free to rotate at both ends, so a more efficient solution is to fix the ends of the cylinders to the outer and inner parts of the sliding frame. In this case alignment is especially important, so preferably the force of each support cylinder 28, 29 is aligned with a plane defined by the sliding axes of the laterally spaced sliding members 24, 25 as shown in FIG. 2.

Figure 3:
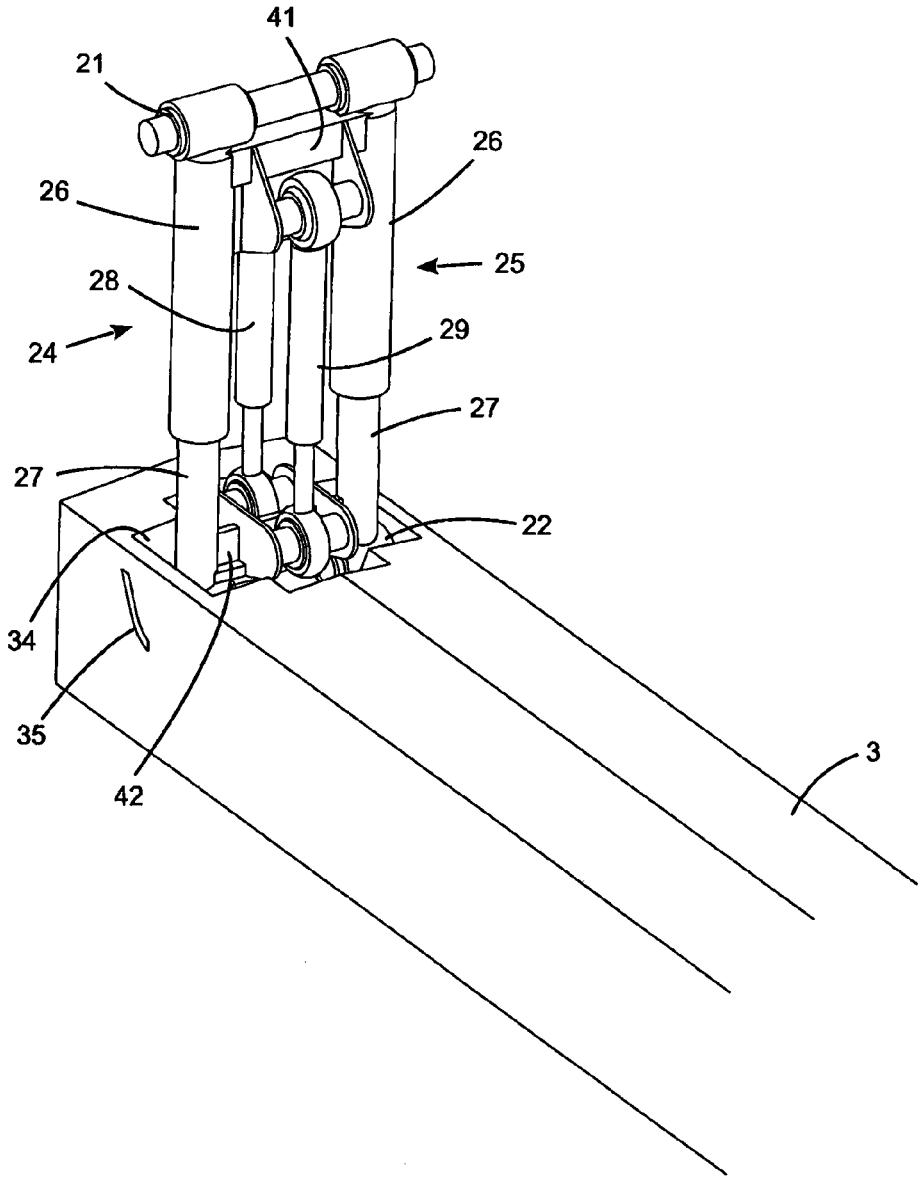
FIG. 3 is a perspective view of an alternate, second possible arrangement of the first locating linkage of the hull locating arrangement.
Figure 4:
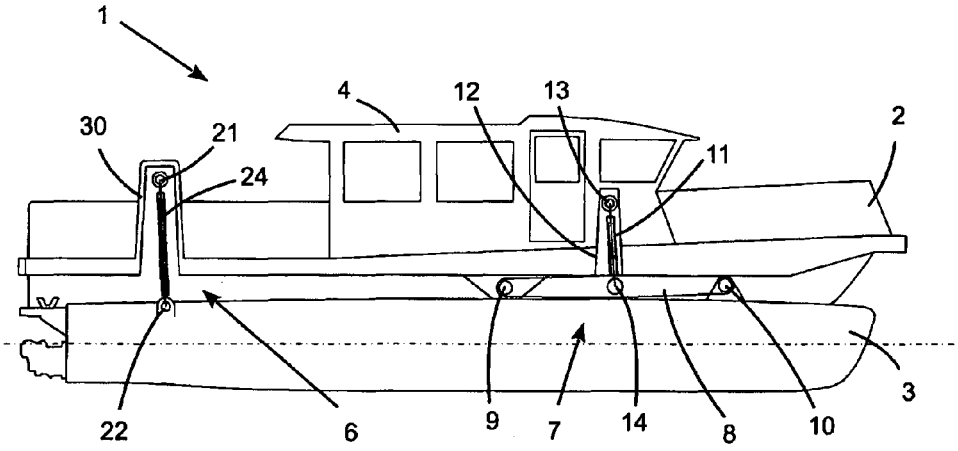
FIG. 4 is a side view showing a compression of a suspension system employing the hull locating arrangement of the present invention.
Figure 5:
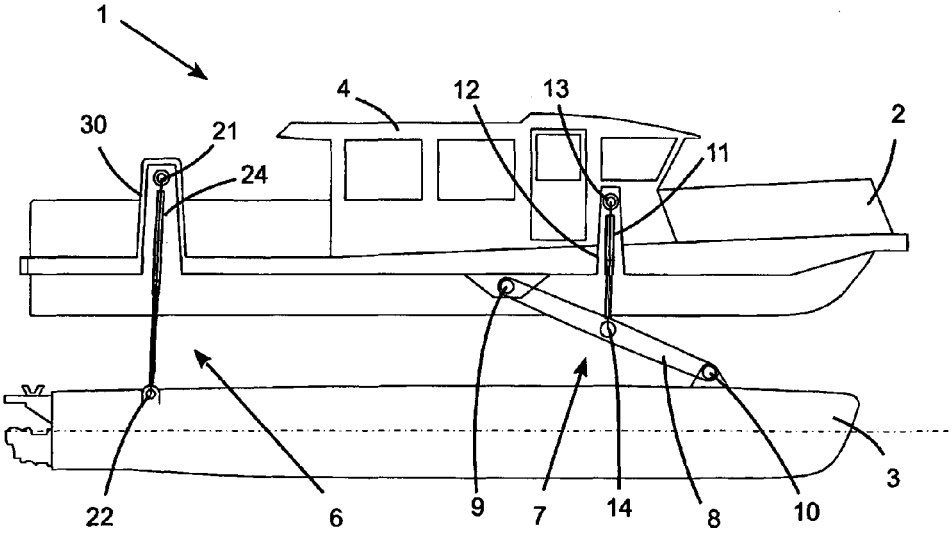
FIG. 5 shows suspension extension or rebound.

Preferably the outer parts 26 of sliding members 24 and 25 are laterally connected by a beam 41 as shown in FIG. 3 and the inner parts 27 are connected by a beam 42 to improve the rigidity of the sliding frame and reduce variations in alignment of the inner and outer parts. The operation and life of the sliding frame can be improved by minimising such misalignment and by minimising the side load on the bearings between the inner and outer parts through keeping the line of action of the total force from the support means as close to the pivot axes of the sliding frame as possible.

Where the width of the back hull locating linkage is limited and two support cylinders are used, the support cylinders can be positioned on either side of the plane defined by the axes of the two sliding members as shown in FIG. 3.

As discussed with respect to FIG. 2, the support cylinders of the arrangement shown in FIG. 3 can be rigidly fixed between the inner and outer parts of the sliding frame even when the support cylinders are not in line with the sliding members, as long as the axes of both cylinders and both sliding members are parallel.

Figure 6:
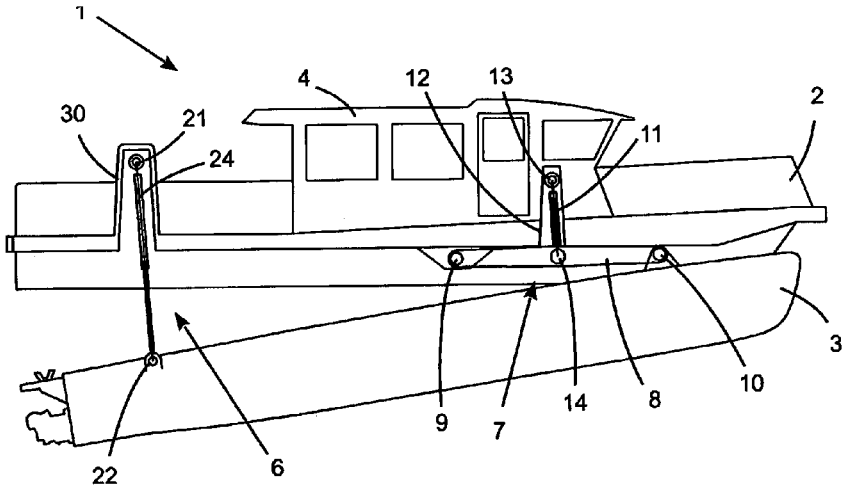
FIG. 6 shows suspension pitch in the hull nose up direction.
Figure 7:
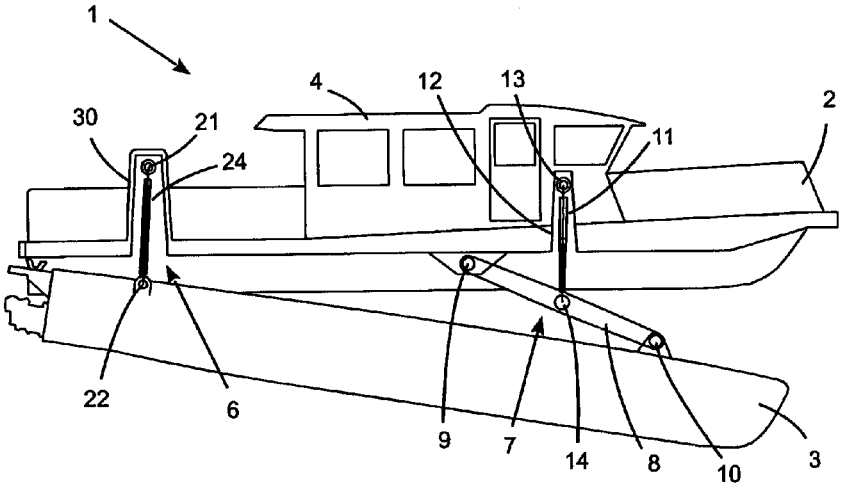
FIG. 7 shows suspension pitch in the hull nose down direction.

FIGS. 4 to 7 show the range of displacements possible between the hulls and the body. The suspension is fully compressed in FIG. 4 and fully extended in FIG. 5. In FIG. 6 the suspension is in a full pitch in the hull nose up direction and similarly in FIG. 7 hull nose down full pitch travel is shown. When the left and right hulls of the catamaran pitch in opposite directions, a warp mode (not shown) is possible.

Figure 8:
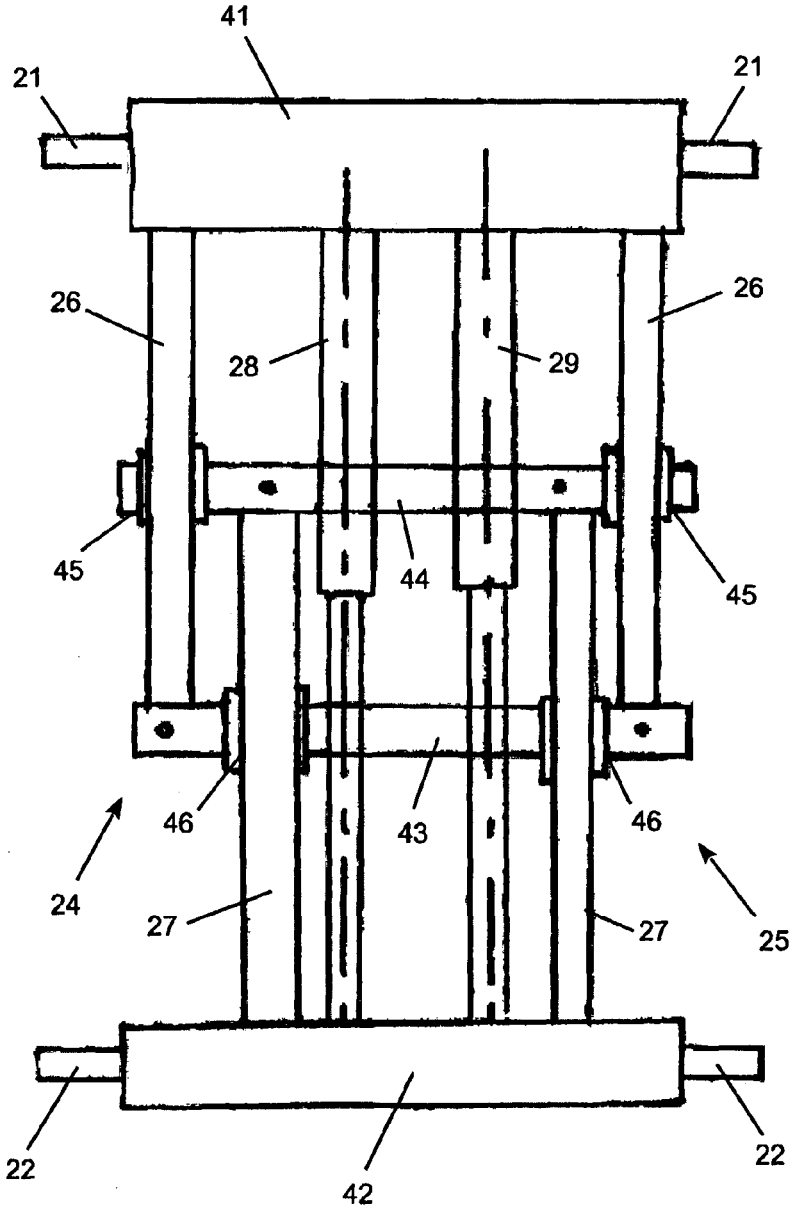
FIG. 8 is a diagrammatic view of a third possible arrangement of the first locating linkage of the hull locating arrangement.

In FIG. 8, the inner 27 and outer 26 parts of the laterally spaced sliding members 24 and 25 are not concentric. A lower-mid beam 43 braces between the lower ends of the outer parts 26 and locates bushings 46 around the inner parts 27. Similarly an upper-mid beam 44 braces between the upper ends of the inner parts 27 and locates bushings 45 around the outer parts 26. This arrangement can increase the torsional rigidity of the sliding members by forming an upper frame and a lower frame and can improve serviceability by placing all the bushings in more easily accessible locations. The upper (or outer) frame comprises the outer parts 26, the lower-mid beam 43 and the upper beam 41 between the tops of the outer members. The lower (or inner) frame comprises the inner parts 27, the upper-mid beam 44 and the lower beam 42 between the bottoms of the inner members. As with the arrangement shown in FIG. 3, the support rams 28 and 29 can be mounted directly between the upper beam 41 and the lower beam 42 in any arrangement desired such as the longitudinal spacing shown in FIG. 3 or the lateral spacing shown in FIG. 8.

Figure 9:
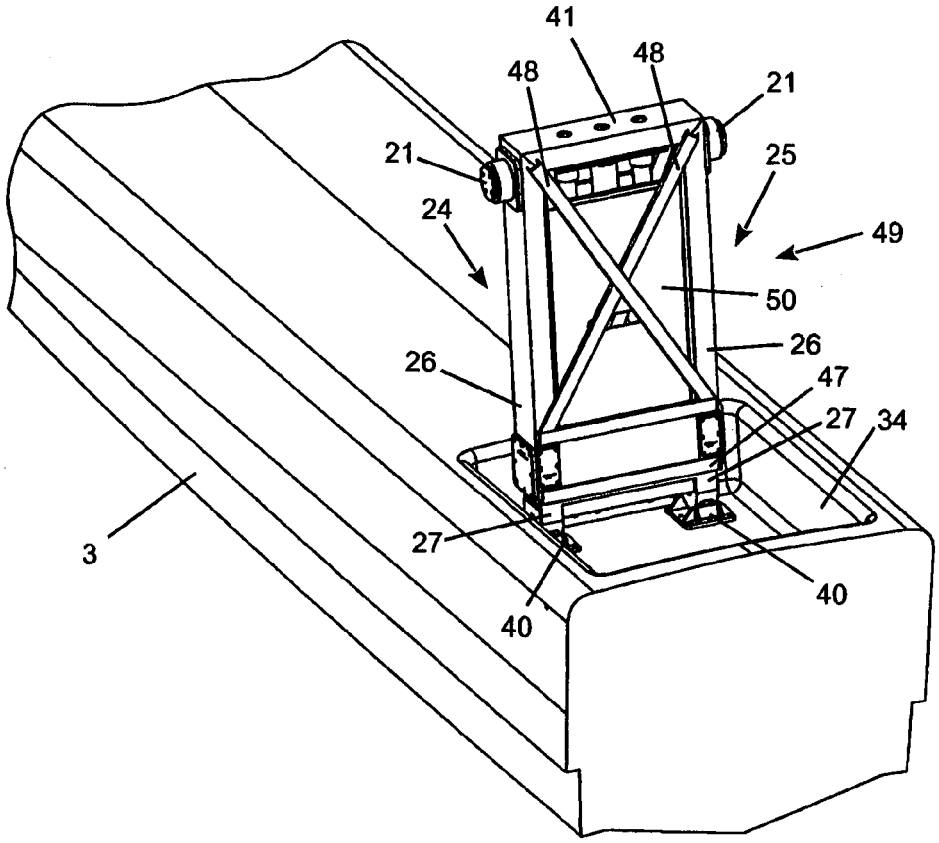
FIGS. 9 and 10 are perspective views of a fourth possible arrangement of the first locating linkage of the hull locating arrangement.
Figure 10:
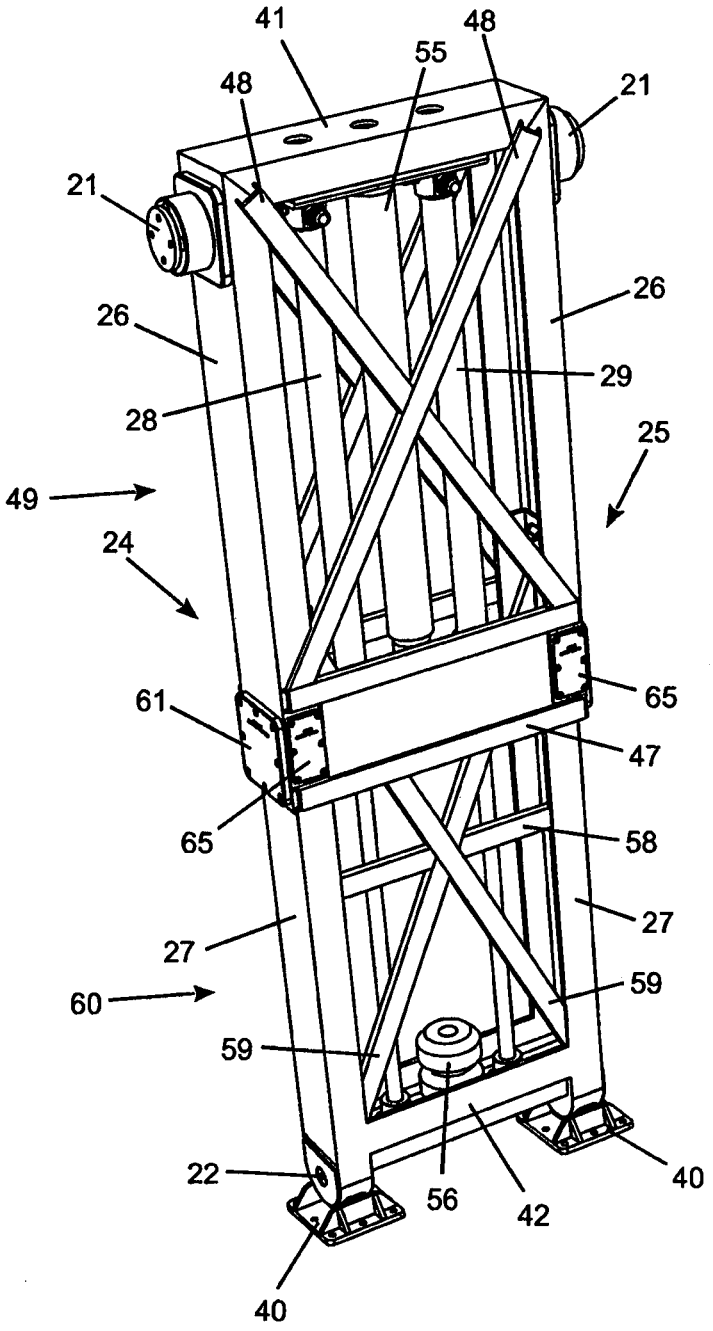
Figure 11:
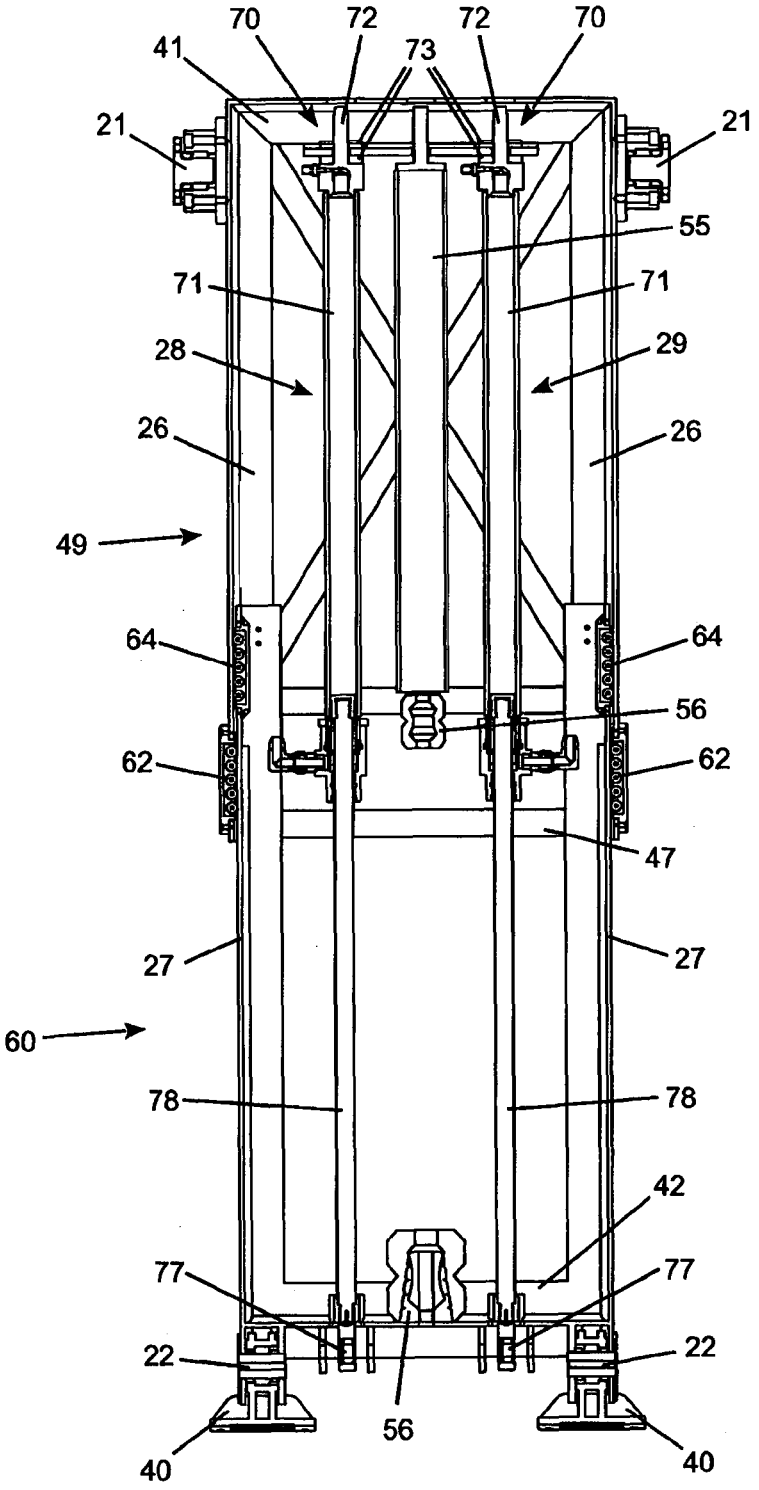
FIG. 11 is a cross sectional view of the arrangement in FIG. 10.

FIGS. 9 to 11 show another preferred arrangement of sliding linkage, again shown towards the back of the hull as a back hull locating linkage (although again it could be used towards the front of the hull if desired). The lower end is again shown recessed into a well 34 in the hull in FIG. 9. The laterally spaced sliding members (24, 25) are now nesting U-section beams in place of the concentric tubes shown in FIGS. 2 and 3 or the pairs of adjacent tubes shown in FIG. 8. The outer parts 26 of each sliding member are fixed to each other by the top beam 41, plus a lower brace 47 and two diagonal braces 48 on each side (ie front and back) forming an outer frame 49. The pivots (bushings or bearings) 21 between the outer frame and the body form the body end pivot axis. The hull end pivot axis is formed by bushings or bearings between the inner parts 27 and the mount brackets 40. In FIG. 9 the sliding linkage is shown in the compressed position with part of the hull shown, but the body omitted for clarity. Cover plates 50 are shown between the outer parts 26 and fill much of the rectangular outer frame which they contribute to forming. The cover plates 50 can be used to add stiffness to the rectangular outer frame in place of or in addition to the diagonal braces 48 and/or as shields to simply to protect the hydraulic components from direct exposure to the elements and/or to provide a barrier to deflect water flowing over the top of the hull (for example to provide some protection of an engine air intake if the engine is located in or on the back of the hull). Additionally or alternatively, similar cover plates can be provided between the inner parts 27 to fill some or all of the rectangular frame they form.

In FIGS. 10 and 11 the locating linkage is shown in the fully extended position, with the hull omitted for clarity and the cover plates omitted to reveal the support rams 28 and 29 and an optional compression stop tube 55 and compression stop resilient elements 56. While it is possible to package compression and rebound travel limit stops within the U-shaped vertical beams of the inner and outer frames, it can be more space efficient to package one or both functions separately.

The inner parts 27 of each sliding member are fixed to each other by the lower beam 42, plus mid brace 58 and diagonal braces 59 forming an inner frame 60. Bearing covers 61 on the outer frame 49 shield roller bearings 62 visible in the sectional view of FIG. 11. The roller bearings 62 are mounted to the outer frame 49 and bear on the inner frame 60 (or a bearing surface fixed to the inner frame). Similarly roller bearings 64 are mounted to the inner frame and bear on the outer frame 49 (or a bearing surface fixed thereto). The roller bearings 62 and 64 resolve lateral and roll forces between the hull and the body. Similarly roller bearings are provided on the front and back of the inner and outer frames (such as under bearing covers 65 on the outer frame) to resolve bending loads in the locating linkage in a plane perpendicular to the pivot axes of the linkage pivots 21 and 22. Alternatively, some or all of the roller bearings forming the sliding mechanism between the inner and outer frames can be replaced by sliding bearings and any or all can be adjustable to ensure correct alignment and correct for wear.

In the example shown in FIG. 11, the joints 70 connecting the cylinder portions 71 of each of the rams 28 and 29 to the top beam 41 are shown as a pair of annular bushings 73 around a pin 72. In each case one bushing is between the top of the cylinder body and the top beam, the other bushing is between the top beam and a washer held on the pin by a nut. The lower ends of the rams (ie the rod ends 77 on the ends of rods 78) can be connected to part of the inner frame such as the lower beam 42 or to mounts adjacent to the frame mounts 79. The mounting axis of the rod ends 77 does not need to be aligned with the joint axis of the frame mounts 40 which form the hull pivots 22.

If the braces 58 and 59 are omitted from one side of the lower frame as shown, then support brackets can be added between the lower brace 47 on the outer frame and the lower ends of the cylinder portions 71 to prevent or limit relative motion and protect against buckling of the rams 28 and 29.

The cross-section of FIG. 11 (cut through the locating linkage of FIG. 10) is cut through the pivot axes of the body pivots 21 and the hull pivots 22, the locating linkage being substantially symmetrical about this plane. The centre-lines of the rams 28 and 29 also lie in this plane and the roller bearings are symmetrical about this plane, ie if the sliding axes of the sliding mechanism between the inner and outer frames are assumed to be though the centroid axes of the outer and/or inner U-shaped beams 26, 27, then in the illustrated example the rams are parallel with the sliding axes and lie in the same plane as the sliding axes and the pivot axes.

Figure 12:
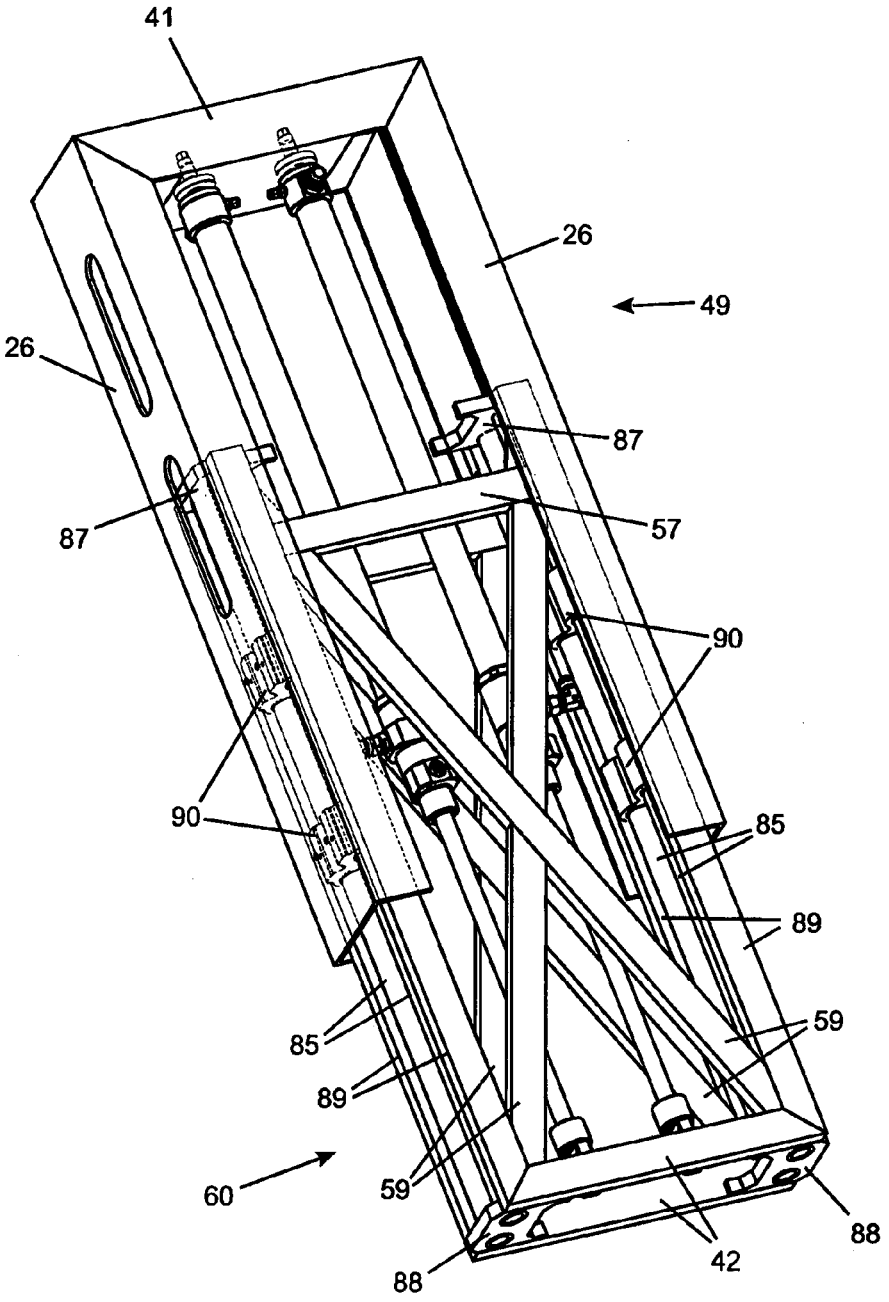
FIG. 12 is a perspective views of a fifth possible arrangement of the first locating linkage of the hull locating arrangement.
Figure 13:
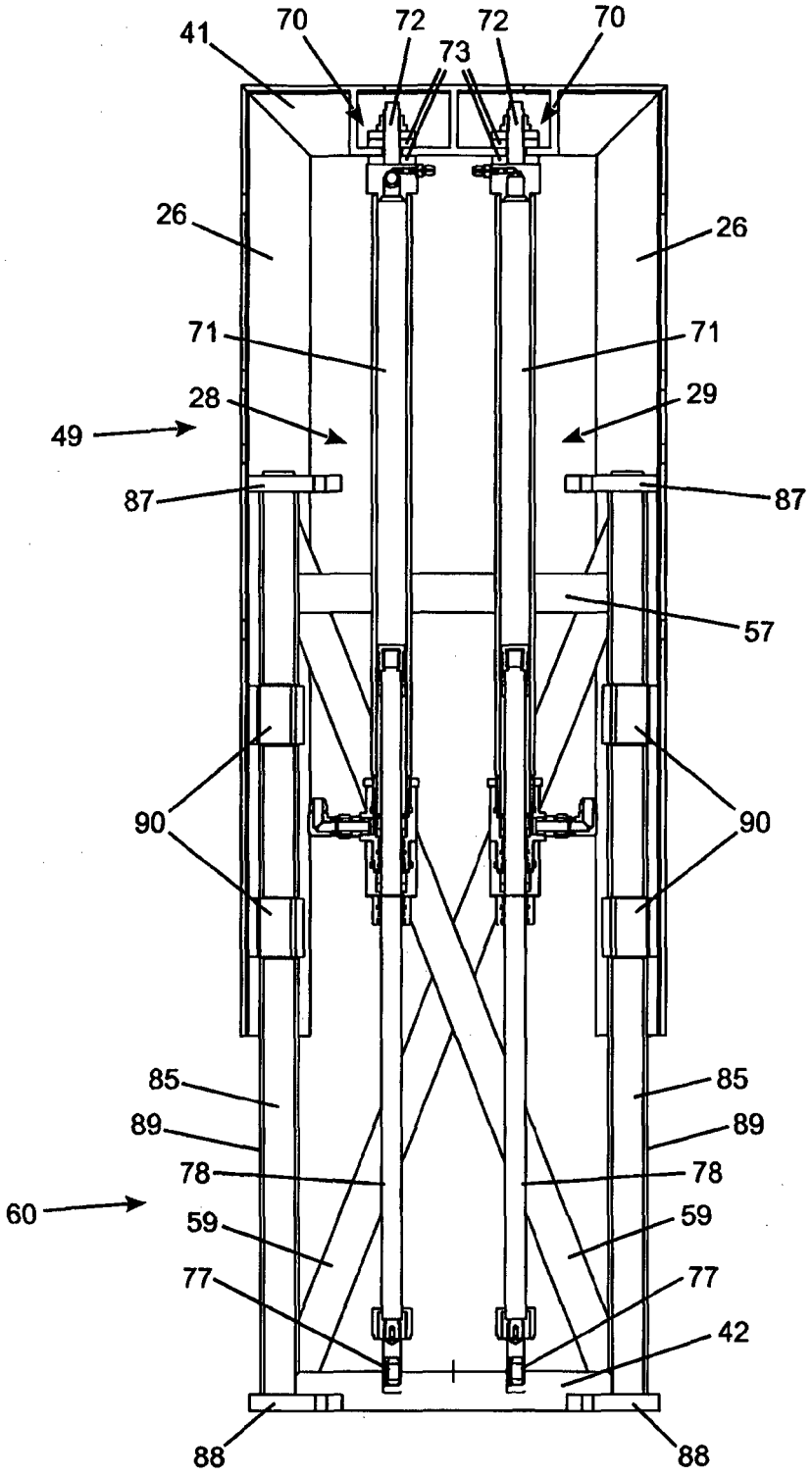
FIG. 13 is a cross sectional view of the arrangement in FIG. 12.

The inner and outer frames can be complex to manufacture to suitable bearing tolerances (due to distortion if welded together for example) and it can be difficult to machine the desired surfaces to the correct tolerances once the frames are assembled, so FIGS. 12 and 13 show a modified construction of the arrangement from FIGS. 9 to 11 whereby the bearings and planar running surfaces of the inner and outer frames are replaced by rods and cylindrical bushings. The arrangement combines elements of the arrangements from FIG. 2 and FIGS. 9 to 11 with additional modifications. A pair of rods or tubes 85 are positioned in each side of the inner frame 60, between pairs of side beams 89. Each pair of rods is fixed to an upper plate 87 at their top end and to a lower plate at their lower end. The upper plates 87 are fixed to the upper ends of the side beams 89. The lower plates 88 are fixed to the lower beams 42 on the front and back of the frame. The front and back of the inner frame each include a lower beam 42, an upper beam 57, two side beams 89 and two diagonal braces 59 and these components can be fixed together into a front and a back assembly prior to mounting of the running surfaces (of the rods). The advantage of this construction is that the alignment of each rod in a pair of rods is easily achieved by the machining of the plates 87 and 88 and that the alignment of the two pairs of rods within the inner frame can be assured through the fixing of the plates to the front and back assemblies of the inner frame after the front and back assemblies have been welded or otherwise fixed together.

Bearing or bushing blocks 90 can be fixed to the U-shaped beams of the outer frame 49 after the outer frame has been assembled. The outer frame can include additional bracing as shown in FIGS. 9 to 11. The outer and/or inner frames can again include covers to brace between the beams of the frames and provide protection and water deflection as previously discussed. The bearing or bushing blocks 90 preferably utilise sliding bushing material sleeves such as PTFE coated shells and can be split to allow replacement of the sliding bushings. Providing the bushings for both adjacent rods of a pair in a single block 90 (or split block that fits around both rods) again allows for the blocks to be machined accurately prior to fitting to the outer frame.

Each pair of rods 85 with the upper and lower bushing blocks 90 tied together by the U-shaped beams 26 of the outer frame are similar in function to the outer parts 26 and inner parts 27 of the laterally spaced sliding members 24 and 25 in FIG. 2, so each pair of rods and bushing blocks could be referred to as one of the laterally spaced sliding members.

Although not shown, compression stops can be provided in the locating linkage, for example, by placing resilient stops inside the top corners of the outer frame attached to the U-shaped beams 26 and 41. Such stops can act on the upper plates 87 for the rods or on brackets attached to the upper plates. Alternatively the compression stops between the inner and outer frames can be attached to the upper plates 87 of the inner frame and act on the top beam 41 of the outer frame. The upper plates 87 can be stepped to allow the compression stops to be packaged adjacent to the rods 85 to reduce the dead length in the locating linkage. Similarly rebound stops (not shown) can be provided, for example on brackets attached to the U-shaped beams 26 of the outer frame just above the upper of the bushing blocks 90, to contact the underside of the upper plates 87 of the inner frame.

The cross-section of FIG. 13 (cut through the locating linkage of FIG. 12) is cut through the pivot axes of the body and hull pivots (not shown) in a similar manner to FIG. 11 and again the locating linkage is substantially symmetrical about this plane and as is preferable, the centre-lines of the rams 28 and 29 also lie in this plane. If the sliding axes of the sliding mechanism between the inner and outer frames are defined as being half way between the primary axis of each rod 85 in a pair forming part of the laterally spaced sliding members 24 and 25, then in the illustrated example the rams are parallel with and lie in the same plane as the sliding axes.

Figure 14:
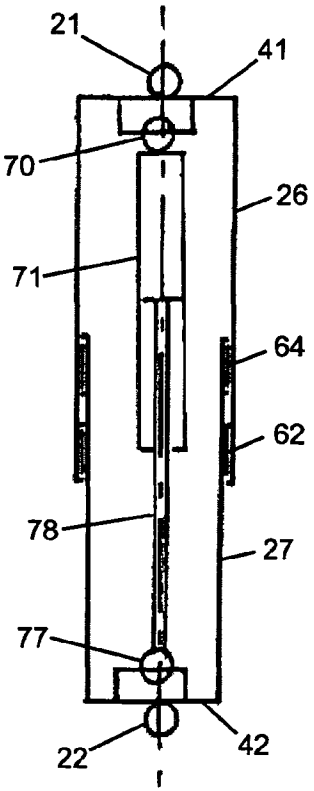
FIG. 14 is a diagrammatic side view of the arrangement from FIG. 10.

The arrangements shown in FIGS. 9 to 13 provide lower forces in the bearings of the sliding mechanism than offsetting the centre lines of the rams from the plane through the pivot axes of body and hull pivots 21 and 22. FIG. 14 shows a diagrammatic side view of the arrangement of FIGS. 9 to 11.

Figure 15:
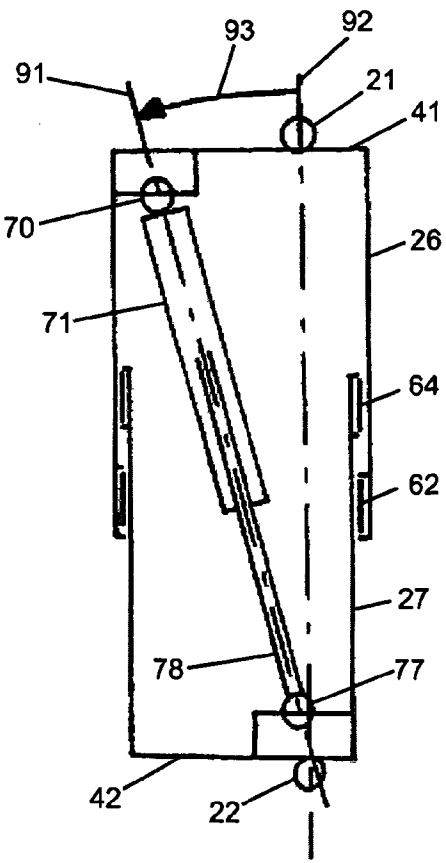

However in any arrangement of the present invention it can be beneficial to maintain a small load on at least some of the bearings in one direction around the static equilibrium point of the vessel at ride height. To this end the centre-line 91 of the rams (and therefore, when the end joints are positioned on the centre-line to minimise bending loads in the rams, the line of action of the rams) can be angled slightly relative to the plane 92 through the pivot axes of body and hull pivots 21 and 22 as shown in FIG. 15. The angle (as shown by the arrow 93) can be up to 30 degrees at mid stroke or ride height, but is preferably less, for example 20 degrees, 10 degrees, 5 degrees or as in FIG. 14 substantially zero. Where the plane through the pivot axes of the body and hull pivots is significantly inclined (and it can be up to 40 degrees from perpendicular to the body) the angle of the ram line of action is preferably not greater than another 15 degrees in the same direction, but can be up to 30 degrees back towards perpendicular to the body. The rods 78 can be joined to the lower frame by joints 77 at any position on the inner frame, but preferably near the lower beam 42 as shown. The cylinder portions of the rams can be joined to the body (not shown) or to a bracket or other structure attached to or forming part of the outer frame 49 as illustrated.

Figure 16:
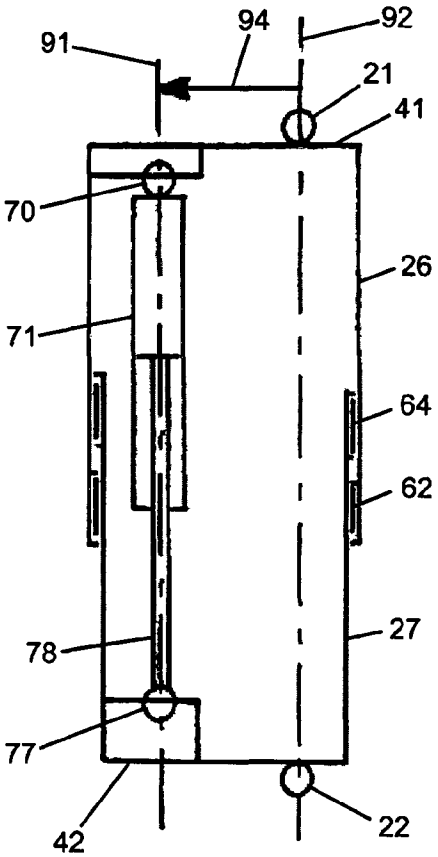
FIGS. 15 and 16 are diagrammatic side views of modifications to a first locating linkage of the hull locating arrangement of the present invention.

Alternatively or additionally, to maintain a small load on at least some of the bearings in one direction around the static equilibrium point of the vessel at ride height, the line of action or centre-line 91 of the rams can be offset from the plane 92 through the pivot axes of body and hull pivots 21 and 22 as shown by the arrow 94 in FIG. 16. The offset 94 is preferably less than 5 percent of the length of the hull, but can be up to 10 percent of the length of the hull where the hull is relatively short (compared to the length of the vessel, as for example in the case of a hull on a quadmaran). Offsets between zero and 5 percent of the length of the hull are also beneficial, for example 1 percent or 2 percent of the length of the hull. Alternatively or additionally the offset 94 is preferably less than 25 percent of the distance between the pivot axes of body and hull pivots 21 and 22 when the locating linkage is at mid stroke or ride height. Again offsets between zero and 25 percent of the distance between the pivot axes of body and hull pivots 21 and 22 when the locating linkage is at mid stroke or ride height can be beneficial, such as 5 and 10 percent.

Even if the line of action or centre-line 91 of the rams is angled or offset from the plane through the sliding axes and/or from the plane through the body and hull pivots 21 and 22, preferably the rams are packaged within the arrangement of inner and outer frames. The advantages of this are many, including: frames can be braced and covered to shield the rams from direct exposure to the elements and direct water flowing over the hulls away from engine components; low bending loads in the locating linkage, reducing required weight; single load path (in side view) for the locating linkage so suspension geometry loads and support loads all flow through the same reinforced points on the body or the hulls; packing of the suspension geometry and support components in the same area, minimising the number of intrusions into the body or hulls; and low preload forces on the bearings or bushings of the sliding mechanism between the inner and outer frames, allowing a low running friction of the mechanism allowing the locating linkage to vary in length.

It should be understood that the sliding arm can be applied to different geometries of hull locating arrangement. For example, the sliding arm can be used in the front locating linkage and a trailing arm could then be used in the rear locating linkage. Alternatively the front leading arm could be replaced with a trailing arm or other suspension geometry. Another alternative for example is to use a pair of sliding arms, one being substantially vertical relative to the body and using a body mount with substantially no rotation so that the vertical sliding arm provides longitudinal location of the hull, the other sliding arm remaining pivoted to the body to permit pitch motions of the hull relative to the body.

Hydraulic rams 28, 29 have been shown in the Figures to support the body of the vessel, but other forms of linear actuator and/or spring could be used. For example a coil or air spring can be used with a linear damper (or shock absorber) and the spring seat can even be adjusted as is known in automotive suspension systems to adjust for example the roll attitude of the body above the hulls.

Modifications and variations as would be apparent to a skilled addressee are deemed to be within the scope of the present invention.

The invention claimed is:

1. A hull locating arrangement for a multi-hulled vessel, the vessel having a body at least partially suspended above at least a first and a second hull by support components, the hull locating arrangement comprising for a said hull a first locating linkage and a second locating linkage to together constrain said hull in the lateral, longitudinal, roll and yaw directions relative to the body, the first and second locating linkages being longitudinally spaced, the first locating linkage including a first part and a second part, one of said parts of the first locating linkage being pivotally connected to the body about a body end pivot axis, the other of said parts being pivotally connected to said hull about a hull end pivot axis, the first locating linkage being arranged to permit relative motion between the first and second parts along at least one sliding axis to thereby permit the first locating linkage to vary in length between the body end pivot axis and the hull end pivot axis, the support components including a first support component adjacent the first locating linkage, the first support component including a first support element providing a support force supporting a portion of the body above the said hull, wherein the support force of the first support element of the first support component has a line of action that is within thirty degrees of parallel to a first linkage plane extending through the body end pivot axis and the hull end pivot axis.

2. A hull locating arrangement according to claim 1 wherein the line of action of the support force of the first support element is offset from the body end pivot axis or the hull end pivot axis or the first linkage plane by a distance of less than ten percent of a length of the first hull.

3. A hull locating arrangement according to claim 1 wherein the at least one sliding axis of the first locating linkage includes at least two laterally spaced sliding axes defining a first sliding plane and the line of action of the support force of the first support element is substantially aligned with said first sliding plane.

4. A hull locating arrangement according to claim 1 wherein the first locating linkage includes bearings or bushings to permit the relative motion between the first and second parts along said at least one sliding axis.

5. A hull locating arrangement according to claim 1 wherein the hull end pivot axis and the body end pivot axis of the first locating linkage of said hulls are aligned substantially laterally with respect to the body of the vessel.

6. A hull locating arrangement according to claim 1 wherein the first support component further includes a second support element the first and/or second support element is connected between the first part and the second part.

7. A hull locating arrangement according to claim 1 wherein said at least one sliding axis is a single sliding axis.

8. A hull locating arrangement according to claim 1 wherein said at least one sliding axis is a pair of parallel first and second laterally spaced sliding axes.

9. A hull locating arrangement according to claim 8 wherein bearings or bushings are provided between the first part and the second part, arranged to effectively constrain the relative motion between the first and second parts to a linear sliding motion along said first and second laterally spaced sliding axes, said sliding axes being parallel to each other and substantially perpendicular to the body and hull end pivot axes.

10. A hull locating arrangement as claimed in claim 1 wherein the first linkage plane of the first locating linkage is substantially perpendicular to the body of the vessel during operation.

11. A hull locating arrangement according to claim 1 wherein the first linkage plane of the first locating linkage is within 40 degrees of vertical relative to the body of the vessel during operation.

12. A hull locating arrangement according to claim 1 wherein the second locating linkage constrains the longitudinal motion of the hull relative to the body.

13. A hull locating arrangement according to claim 1 wherein the support components further include second support components for providing support forces in the second locating linkage between said hull and the body.

14. A hull locating arrangement according to claim 1 wherein the support force of the first support component acts substantially parallel to the at least one sliding axis of the first locating linkage.

15. A hull locating arrangement according to claim 1 wherein the support force of the first support component acts in a direction that is substantially aligned with either the at least one sliding axis of the first locating linkage or a plane defined at least in part by the at least one sliding axis of the first locating linkage.

16. A hull locating arrangement according to claim 1 wherein the first locating linkage is variable in length along a first sliding axis and the variable length of the first locating linkage varies within a range defined as a first locating linkage stroke distance and the first support component is arranged such that the resultant force has a line of action substantially aligned with the first sliding axis or passing within a distance from the first and second pivot axes of the first locating linkage that is less than twenty-five percent of said stroke distance.

17. A hull locating arrangement according to claim 1 wherein the first support component is connected between the first part and the second part.

18. A multi-hulled vessel including a main body and at least one left hull and at least one right hull, each of said at least one left hull and at least one right hull being moveable with respect to the main body, wherein:

at least one hull of said at least one left hull and at least one right hull is located relative to the main body by a hull locating arrangement as claimed in claim 1.

19. A multi-hulled vessel as claimed in claim 18, wherein the second locating linkage is a fixed length arm between the main body and the hull, a first end of the second locating linkage is rotatably connected to the main body by a first joint having a first pivot axis, a second end of the second locating linkage is rotatably connected to the hull by a second joint having a second pivot axis.

20. A multi-hulled vessel as claimed in claim 18, wherein the first locating linkage and the second locating linkage are arranged to permit motion of the hull in the heave and pitch directions.

21. A multi-hulled vessel as claimed in claim 18 wherein the first support component includes multiple devices, the resultant force of said multiple devices having a line of action substantially parallel to the at least one sliding axis of the first locating linkage or passing within a distance from the first and second pivot axes of the first locating linkage that is less than twenty-five percent of said stroke distance.

* * * * *